United States Patent [19]

Peterson et al.

[11] Patent Number: 5,012,660

[45] Date of Patent: May 7, 1991

[54] CONTROL SYSTEM AND METHOD FOR COMPENSATING FOR SPEED EFFECT IN A TANDEM COLD MILL

[75] Inventors: Robert S. Peterson, Indiana Twp., Allegheny County, Pa.; John A. Larsen, Phoenix, Ariz.

[73] Assignee: AEG Westinghouse Industrial Automation Corporation, Somerville, N.J.

[21] Appl. No.: 443,695

[22] Filed: Nov. 29, 1989

[51] Int. Cl.[5] ..... B21B 37/00

[52] U.S. Cl. ..... 72/8; 72/10; 72/17; 72/19; 72/205

[58] Field of Search ..... 72/8, 9, 10, 11, 12, 72/14, 15, 16, 17, 19, 205

[56] References Cited

U.S. PATENT DOCUMENTS

| | | | |
|---|---|---|---|
| 3,507,134 | 4/1970 | Silva | 72/8 |
| 3,740,983 | 6/1973 | Peterson et al. . | |
| 3,765,203 | 10/1973 | Peterson . | |
| 3,768,286 | 10/1973 | Peterson . | |
| 3,782,151 | 1/1974 | Peterson et al. . | |
| 3,808,858 | 5/1974 | Connors et al. | 72/8 |
| 3,848,443 | 11/1974 | Peterson et al. . | |
| 3,906,764 | 9/1975 | Mueller | 72/8 |
| 4,011,743 | 3/1977 | Peterson et al. . | |
| 4,016,735 | 4/1977 | Peterson . | |
| 4,286,447 | 9/1981 | Peterson | 72/9 |

FOREIGN PATENT DOCUMENTS

| | | | |
|---|---|---|---|
| 28593 | 7/1972 | Japan | 72/16 |
| 428805 | 5/1974 | U.S.S.R. | 72/10 |

*Primary Examiner*—Lowell A. Larson
*Assistant Examiner*—Thomas C. Schoeffler
*Attorney, Agent, or Firm*—R. V. Westerhoff; Suzanne Kikel

[57] ABSTRACT

In an arrangement for a tandem cold mill in order to compensate for "speed effect," each stand has a roll force memory unit and an oil film roll force controller unit which operate together, and in conjunction with a tensiometer, to maintain a relatively constant roll gap during the acceleration and deceleration phases of the mill. In threading, in tailing out, and in a full run speed of the mill, the roll force memory unit is constantly operating to obtain a "lock on" roll force reference for the stand prior to the acceleration or deceleration phase. A roll force error signal, which is the difference between a roll force reference of the roll force memory unit and an instantaneous roll force, enters the oil film roll controller. A proportional integrator type controller in the oil film roll force controller unit changes the roll force error signal within a limit of +25% of the desired tension. This oil film roll controller produces a tension reference signal which is compared to the desired tension and selectively with the actual tension to produce a tension error signal used to control the roll gap control system of the stand or used to provide a speed change reference for the downstream stand.

36 Claims, 3 Drawing Sheets

CONTROL SYSTEM AND METHOD FOR COMPENSATING FOR SPEED EFFECT IN A TANDEM COLD MILL

BACKGROUND OF THE INVENTION

1. Field of the Invention

The present invention relates generally to a control system and method for compensating for "speed effect" in a stand of a tandem cold mill. More particularly, it relates to maintaining a constant roll force and a constant roll gap to produce a relatively higher percentage of "on gauge" material in that portion of the workpiece traveling through the stand during the acceleration and deceleration phases of the mill. The length of the workpiece is on gauge relative to the gauge of the remaining length of workpiece rolled in the other phases of the mill.

During threading and tailing out of a material in either strip or sheet form in a tandem cold mill, the stands of the mill are driven at a relatively low rate of speed, and the tension of the material of the workpiece between adjacent stands is regulated by the speeds of the stands. During the "full run of the mill," the stands are driven at relatively high rates of speed, where the material tension regulators are switched from regulating the interstand tension by controlling the speeds of the stands to regulating the interstand workpiece tension by controlling the roll gap of each stand. That is, strip tension is controlled at low speeds by controlling the speeds of the stands and at high speeds by controlling the roll gap.

In the transition from the threading stage to the "full run stage" the stands are accelerated, and, in the transition from the "full run stage" to the tailing out stage, the stands are decelerated. During these acceleration and deceleration phases, there occurs what is known in the industry as "speed effect." This "speed effect" causes the roll force in the stand to increase when the mill accelerates and to decrease when the mill decelerates. This naturally results in a change in the actual roll gap. The actual roll gap is a sum of the mill stretch and the apparent roll gap, which is held constant in stretch and the apparent roll gap, which is held constant in that the roll gap mechanism is fixed.

It has been theorized, but not proven, that this "speed effect" results from the fact that as the stand speed increases, oil tends to get into the bearing chocks thereby forcing the roll gap to close resulting in the material "going thin." Likewise, when the stand speed decreases, oil tends to leave the bearing chocks thereby forcing the roll gap to open, resulting in the material "going heavy." This "speed effect" has also come to be known as "oil film effect." Regardless of whether or not this "oil film effect" theory is correct the opening and closing of the roll gap is a reality in the speed transitions of the mill.

2. Description of the Prior Art

It is well-known in the industry that "on gauge" material is produced by maintaining a relatively constant roll gap where the actual roll gap is regulated by considering the apparent roll gap and the modulus of the mill stand. Several systems including the interstand tension regulators, the entry automatic gauge control, and the delivery automatic gauge control are employed in the present day tandem cold mills for controlling the gauge in the workpiece. Some examples are disclosed in U.S. Pat. Nos. 3,740,983; 3,765,203; 3,768,286; 3,848,443; 4,011,743; 4,016,735; and 4,286,447.

These prior roll gap control systems attempt to maintain a constant roll gap to produce an on gauge material in the threading phase, in the high speed full run phase, or in the tailing out phase of the mill, without providing roll gap control means or method for compensating for speed effect or oil film effect occurring in the acceleration or deceleration phases of the mill.

SUMMARY OF THE INVENTION

The present invention has solved the above-described problems of not compensating for speed or oil film effects occurring during the acceleration or deceleration phase of the mill by providing a simple, corrective roll gap control system and method for maintaining a relatively constant actual roll gap in a stand during the acceleration or deceleration phase of the mill.

The present invention provides in each stand of a tandem cold mill a roll force memory unit and an oil film roll force controller which operate together to maintain a relatively constant actual roll gap in the acceleration and deceleration phase of the mill. All the components of the roll force memory unit are continually operating prior to the mill accelerating and decelerating to obtain, and store an updated "lock on" roll force which is equivalent to the roll force in the stand prior to the mill accelerating or decelerating. This "lock on" roll force is combined with the instantaneous roll force to produce a roll force error signal. This roll force error signal is altered a certain percentage of the desired tension for the workpiece by a proportional integrator type controller. The output of this proportional integrator controller is further compared with a desired tension and/or an actual tension in the workpiece to produce an error tension value used to control the roll gap mechanism of the stand to obtain an on gauge length in the workpiece travelling through the mill during the acceleration and deceleration phases of the mill.

The invention provides for controlling either an electromechanical screwdown device, or an hydraulic piston cylinder assembly for roll gap control in either a tandem tin cold mill having smooth rolls in all stands or in a tandem sheet cold mill having smooth rolls in all but the last stand which has sandblasted rolls.

In a mill arrangement where the stand or stands have smooth rolls, and the roll gap mechanism is an hydraulic piston cylinder assembly, the tension is controlled by a roll gap control system. The output signal from a workpiece tension controller may be initially generated by an input from the tensiometer which input is representative of the roll force in the respective stand. This "lock on" roll force as an output from the workpiece tension controller is fed into the roll gap control system and back into an oil lock on roll force reference control and into an oil film roll force reference controller of the invention to provide an updated output from the workpiece tension controller for regulating the roll gap for constant gauge in the workpiece.

In a tandem cold mill arrangement for reducing sheet where the last stand has sandblasted rolls and the downstream stands have smooth rolls, normally the tension in the material between the last two stands is controlled always by the speed of the immediately upstream last stand or downstream stands. The tension on the work piece between the other stands which have smooth rolls is controlled at higher mill speeds by controlling the roll gap of the stand at which the work piece is entering. A logic signal which is initiated after the mill speed exceeds a preset value is used to initially obtain a "lock on" roll force in an oil film lock on reference control for the last stand and to produce a roll force error value representative of a difference between the instantaneous roll force and the "lock on roll" force in an oil film roll force controller for the last stand. This error output is converted into a certain allowable percentage of the desired tension. This roll force error output is part of the input to the workpiece tension controller whose additional input is the desired strip tension and selectively may be the actual tension from the tensiometer. The output from the workpiece tension controller when the work piece is between the last two stands and the last stand has sandblasted rough surface rolls is then preferably used as a change in speed for the downstream stand. When the workpiece is entering a stand with smooth work rolls at higher mill speeds the workpiece tension controller output controls the roll gap of the stand that the workpiece is entering.

It is, therefore, a broad object of the invention to minimize workpiece gauge variation due to speed effects in a stand of a cold tandem mill thereby increasing the production yield of a workpiece.

It is a further object of the invention to provide a control system and method to reduce the amount of delivery gauge of a workpiece that is out of tolerance caused by speed effects during the acceleration and deceleration phases of a mill.

It is a further object of the invention to provide a control system and method which compensate for "speed effects" during acceleration and deceleration phases of the mill, and which cooperate with existing tension regulators and roll gap mechanisms to maintain a constant roll force and therefore a constant roll gap during the acceleration and/or deceleration phases of the mill.

It is a further object of the invention to provide a roll gap control system and method thereof for compensating for speed effects in existing tandem cold mills where the interstand tension regulators are either in the "tension by speed control" mode, or in the "tension by gap control" mode, and where the roll gap control mechanism is either an electromechanical screwdown or an hydraulic piston cylinder assembly.

It is a further object of the invention to provide a roll gap control system for compensating for "speed effects" during acceleration and/or deceleration of the mill, which tracks and records a rolling force representation in the stand prior to acceleration or deceleration and uses this roll force representation as a "lock on roll" force value which is then added to an instantaneous roll force representation to produce a roll force error representation which is transformed into a tension reference output which is a certain allowable percentage of the desired tension.

It is a further object of the invention to provide such a roll gap control system for compensating for speed effects whereby a tension reference is representative of a certain percentage of the desired tension provided by a digital computer of the mill system or by a mill operator.

It is still a further object of the invention to provide in an immediate stand a roll force memory unit circuit which operates during threading, tailing out, and full run operations of the mill to track and store an updated value for the roll force prior to acceleration and deceleration, and which operates during the acceleration and deceleration phase of the mill to provide the lock on roll force value to control the roll gap control means of the stand or the speed of a downstream stand which affects the roll gap of the immediate stand.

A further object is to provide a roll gap control system for a stand of a rolling mill which measures a roll force representation prior to the acceleration and deceleration phases, and stores this information in a memory unit until the acceleration or deceleration phase, at which time the difference between the stored rolled force representation and the instantaneous roll force representation is calculated proportionately to the desired tension, and is used along with the desired tension and/or the actual tension to control roll gap.

A further object of the invention is to obtain a "lock on roll force" or a "lock on roll force representation" which is an average of the roll forces or of the roll force representations considered over a certain time interval prior to the acceleration and deceleration phases, and which "lock on roll force" value may be obtained through computer software of a microprocessor in a subsystem for the mill.

These and other objects of the invention will be more fully understood from the following description of the invention, on reference to the illustrations appended hereto.

DESCRIPTION OF THE PREFERRED EMBODIMENTS

The invention is directed to controlling the gauge of the length of a workpiece such as a sheet or strip traveling through several stands of a tandem cold mill during the acceleration and/or deceleration phases of the mill. However, for simplicity of explanation and description, this disclosure will concern itself generally with the description as applied to a single stand. The stand is represented herein by two work rolls, but it is to be understood that these work rolls may have a backup roll associated with them.

The invention is employed to take into account the "speed effect" or "oil film effect" which is a phenomenon occurring in the mill even when the apparent roll gap remains constant. This phenomenon occurs in the acceleration and the deceleration of the mill where the oil from the gears, bearings, etc. is theorized as causing the roll gap to close upon the increase of the speed of the mill and to open upon the decrease of the speed of the mill.

The invention is particularly disclosed with reference to but not limited to generally two types of multi-stand tandem cold mills, which are a sheet cold mill and a tin cold mill. The sheet cold mill has sandblasted (rough) work rolls on the last stand which is used for minimal reduction and whose primary purpose is to put a surface finish on the workpiece. The remaining stands of the sheet cold mill have smooth rolls, as do all of the stands of a tin cold mill, which is the second type of mill in which the invention is disclosed.

Figure 1:
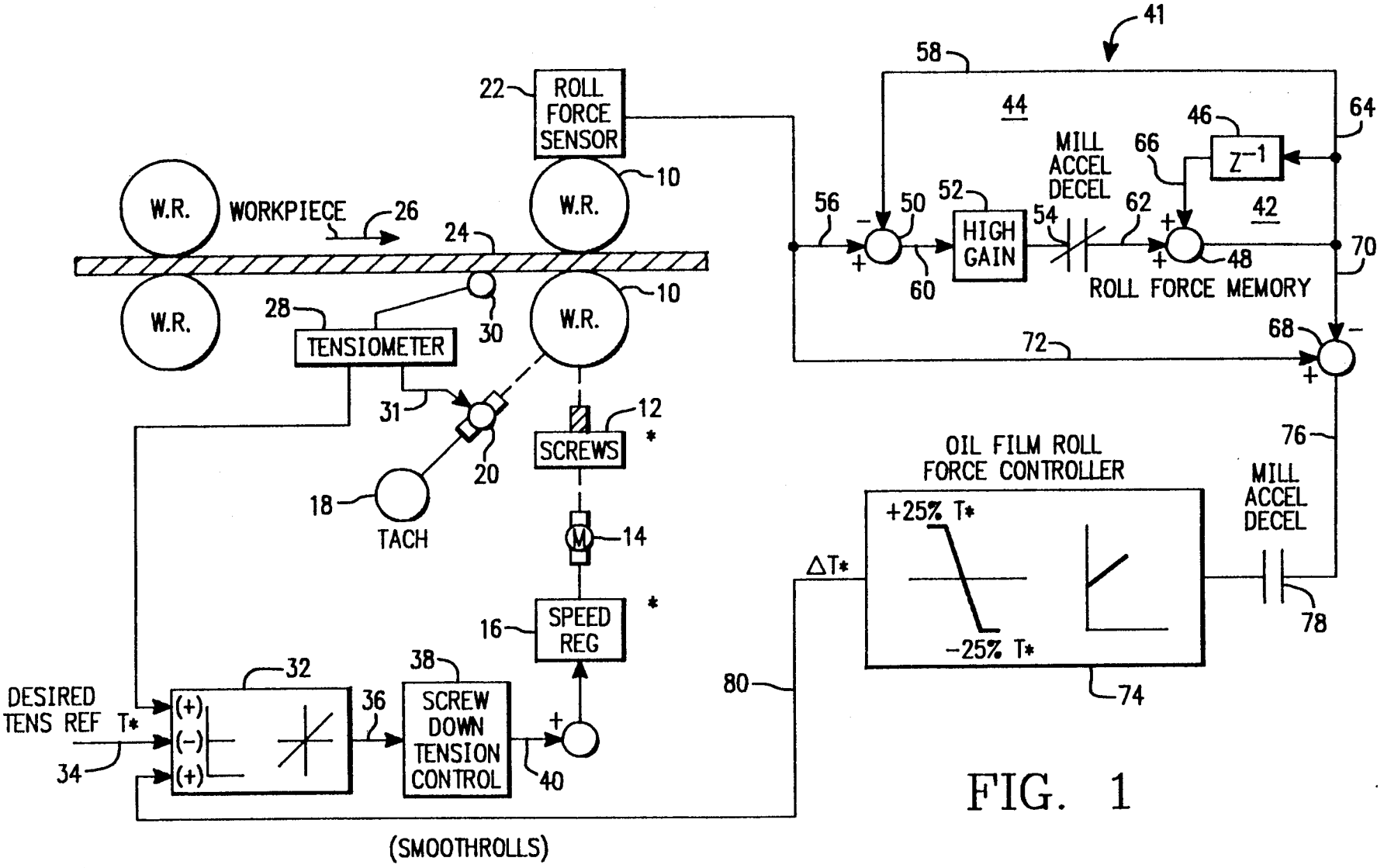
FIG. 1 is a schematic diagram showing in block form a simplified control system of a first embodiment of the invention.

Referring now to FIG. 1, there is shown diagrammatically two work rolls 10 representing a stand of a typical four high mill, where the backup rolls are not shown for the sake of simplicity. This mill arrangement particularly has reference to those stands in a tin or sheet mill having smooth rolls and an electromechanical screwdown mechanism for roll gap control. The screwdown mechanism for adjusting and controlling the roll gap is shown by components 12, 14, and 16; where 12 represents the screwdown mechanism, 14 represents the motor for driving the screwdown mechanism 12, and 16 represents the speed regulator for motor 14. A tachometer for detecting the speed of work roll assemblies 10 is represented at 18, and component 20 is representative of a speed regulator and motor for driving the work rolls 10. Roll force sensor 22 associated with upper work roll 10 measures the rolling force.

A workpiece 24 is traveling in the direction indicated by an arrow at 26 and into the roll bite of work rolls 10. Workpiece 24 travels over a tensiometer 28. Tensiometer 28 is a typical well-known device in the industry which measures strip tension by the force applied to the tension roll 30, and measures the reaction force by strain gage load cells, which force is produced by the tension in workpiece 24.

It is well-known in the industry to regulate tension in workpiece 24 either by controlling the speed of the work rolls 10, where the interstand tension regulators are set to what is referred to as "tension by speed," or by controlling the roll gap where the interstand tension regulators are set to what is referred to as "tension by roll gap control." The "tension by speed" mode is used generally for the slower speeds, such as during threading and tailing out, and the "tension by roll gap control" is used generally for the higher speeds, such as during the full run of the mill.

In the "tension by speed" mode, tensiometer 28 is used as is indicated by lead line 31 in conjunction with components 18 and 20, and a suitable electrical circuit (not shown) to regulate the speed of work rolls 10 and their respective backup rolls (not shown). In the "tension by roll gap control" mode, tensiometer 28 detects and measures the actual tension in workpiece 24. The output from tensiometer 28 is shown along line 30 which goes to summing device 32.

Summing device 32 receives a desired tension reference along line 34 from a digital computer (not shown) of the mill or from the mill operator. The error value from summing unit 32 is the input along line 36 to a screwdown tension controller 38, whose output signal along line 40 is used to regulate the positioning of the screwdown mechanism 12 for adjustment of the roll gap between work rolls 10 through speed regulator 16.

This operation of controlling roll gap control through the tensiometer 28 and screw down mechanism 12 for maintaining a constant roll gap for uniform gauge is continually being performed generally in the full run of the workpiece through the mill when the speed of the mill is in its highest range.

At the lower speeds for threading and tailing out, as stated, the interstand tension regulators of the mill are operating in the "tension by speed" mode whereby the interstand tension in the workpiece is generated by the relative speeds of the adjacent stands.

The principles and operation of the control systems and equipment for implementing the tension by speed mode and the tension by gap control mode are well-known in the art.

Still referring to FIG. 1, the invention is illustrated by the schematic representation in the uppermost right hand corner. A roll force memory circuit 41 which is used to obtain a "lock on" roll force reference has an inner loop 42, and an outer loop 44. Inner loop 42 consists of a delay operator $Z^{-1}$ indicated at 46, and a summing amplifier 48, which is also part of outer loop 44. Outer loop 44 further consists of summing amplifier 50, operational high gain amplifier 52, and a switch 54. Switch 54 is closed during most of the operation of the mill except during the acceleration and the deceleration phases for a continual input of the roll force detected by sensor 22 through loops 42 and 44.

The summing amplifier 50 subtracts a roll force feedback signal provided on lead line 58 by the inner loop 42 from a roll force signal generated by sensor 22 on lead line 56. A signal of summing amplifier 50 is an input on lead 60 for high gain amplifier 52. When switch 54 is closed, the output signal from amplifier 52 on lead 62 is a component for the total input to summing amplifier 48.

The output of summing amplifier 48 along line 64 is the input to the delay operator 46, whose output is added on lead 66 to the input on lead 62 by the summing amplifier 48. The output of summing amplifier 48 is also partial input to a summing amplifier 68 along line 70, and is subtracted from the instantaneous roll force along line 72 by amplifier 68.

Loops 42 and 44 function to continually provide an update of a present roll force reference. The roll force reference is an average of the roll force sampled in over a certain time period and is the value stored in delay operator 46. This averaging of the roll forces over, say, for instance a 200 millisecond time period, can be obtained by recording and storing the roll forces in a micropressor base control system measured at fixed time intervals for the past 200 milliseconds, then dividing the sum of the roll forces sampled during the past 200 millisecond by the number of roll force samples taken during the 200 millisecond time period.

Immediately before the acceleration and deceleration phase, switch 54 in loop 44 is automatically opened thereby interrupting further input into inner loop 42. Inner loop 42 continues to operate at its present input, more about which will be discussed herein.

Directly below roll force memory unit 41 in FIG. 1 is summing amplifier 68 whose input as stated is the instantaneous roll force and the "lock on" roll force reference. During the acceleration and deceleration phases, the "lock on" roll force reference is continually running only through inner loop 42 in that switch 54 is now open. This "lock on" reference is continually being fed into summing amplifier 68.

The "lock on" roll force as stated represents the average of the roll forces taken over the last 200 milliseconds prior to the acceleration or deceleration phase of the mill.

The output from summing amplifier 68 is a roll force error and is input to an oil film roll force controller 74 by lead line 76 when switch 78 is closed to complete the circuit. Switch 78 is only closed during the acceleration or deceleration phase of the mill, at which time switch 54 is opened.

Oil film roll force controller 74 is preferably a well-known PI (proportional-integral) type controller, having linear characteristics and a typically ±25% limit range. This range limits the magnitude of the output signal from controller 74. In effect, the tension reference output, ΔT, of controller 74 can only be changed within this ±25% range with respect to the desired reference tension provided by the mill operator or by the digital computer. This output for controller 74 provides a gain control action to the tension reference output ΔT.

The tension reference output, ΔT of controller 74 represents a change in the tension in the workpiece due to "speed effects." This input by lead 80 is positive input and is algebraically summed in summing junction 32. The output on lead 36 of summing junction 32 is proportional to the input and operates the screwdown mechanism for roll gap control.

During the acceleration phase from the threading phase into the full run phase of the mill, the interstand tension regulators are being switched from the "tension by speed" mode to the "tension by gap" mode, the screwdown mechanism 12 may be operated by using the inputs along leads 34 and 80 into summing junction 32 with no input from tensiometer 28. During the deceleration phase, the mill has been running full and the tension regulators have been in the tension by gap mode. The "lock on" roll force prior to the start of the deceleration phase, or as the case may be to the start of the acceleration phase at which time the workpiece tension control regulators are switched from tension by speed to tension by gap is stored in loop 42 and the roll gap, and thus the roll force in the stand is regulated to this value.

At this time, there may be only a short period of time where the input along lead 30 from tensiometer 28 may be a component for the output of summing junction 32 in which case, the input along leads 30, 34, and 80 are algebraically summed in junction 32 for an output at 36. However, once the mill and the tension regulators are switched entirely to the "tension by speed" mode for the tailing out phase, the output from screwdown tension control 38 is interrupted, and the output of the screwdown speed regulator 16 will be zero and, thus, the speed of the screwdown motor 14 will be zero.

From the above, it can be understood that during the acceleration and deceleration phases, summing junction 32 generally receives input which is representative of a tension reference from oil film roll force controller 74 and a desired tension reference, and that the screwdown tension controller 38 operates on a differential value output from summing junction 32 to control screwdown mechanism 12 for work rolls 10. The output 36 of summing junction 32 is a tension error. Under dynamic conditions this tension error will be greater than zero, and at steady state conditions, this tension error will be zero.

From the above it can be understood that the interstand back tension in workpiece 24 may be changed by the oil film roll force controller 74 which continually receives its input from roll force memory unit 41. This change in back tension is within allowable limits in the range of a ±25% of the desired tension supplied by the operator to maintain a relatively constant roll gap by using a "locked on" roll force value which was an average of the roll forces in the stand prior to the acceleration or deceleration phase.

At the end of this speed change phase, switch 78 is opened and the output from oil film roll force controller 74 is slowly decayed to zero (through suitable means not shown) with the input to oil film roll force controller 74 being removed and set to zero. When the switch 54 which connects an input to inner loop 42 is closed, outer loop 44 now proceeds to monitor the roll force so that a new lock on roll force will be established once the mill speed starts to change again, and when the tension of the workpiece 24 is controlled by adjusting the roll gap of work rolls 10.

Oil film roll force controller 74 is not energized again until a selected time period after the mill is being accelerated or decelerated. In order to store a "lock on" roll force reference which may be used during the threading, full run, and tailing out of the mill, switch 54 is closed and the present instantaneous roll force is continually being fed into loops 42 and 44 of roll force memory circuit 41. Switch 78 is opened and therefore no input signal is sent to oil film roll force controller 74. As already stated, switch 78 is closed during the acceleration and deceleration phases with switch 54 being opened.

In the tailing out phase, after workpiece 24 has left the mill, components 41, 68, and 74 of the invention are set to zero in preparation for the next rolling operation for the mill.

During the operation of the mill, as stated hereinabove, the interstand tension regulator controls are being switched back and forth from the "tension by speed" mode for the slower speeds to the "tension by gap control" mode for the higher speeds. When the mill is switching from the "tension by speed" mode to the "tension by gap" mode, a delay device (not shown) is into the control system so that the oil film roll force controller 74 is only activated after a time period of, say, 0.12 seconds has elapsed after initiation of its operation. This time period is necessary in order to allow the components of the "tension by gap" control system enough time to achieve a steady state condition. During this time, and at any other time, the mill operator can also change the roll gap setting. This can be done by deactivating the oil film roll force controller 74 through operation of switch 78, and the roll force reference can either be updated or retained in roll force memory circuit 41.

In FIG. 1, regardless of what stage of operation the mill is in, if tensiometer 28 is functioning, the output signal from tensiometer 28 is fed into summing junction 32, and this input on lead 30 is used in conjunction with that on leads 34 and 80 to generate an output on lead 36 for the control of the roll gap of work rolls 10 by screwdown tension control 38.

The embodiment of FIG. 1 can be applied to any stand of a tin or a sheet mill employing an electromechanical screwdown, and smooth surface workrolls for reduction of the workpiece.

Figure 2:
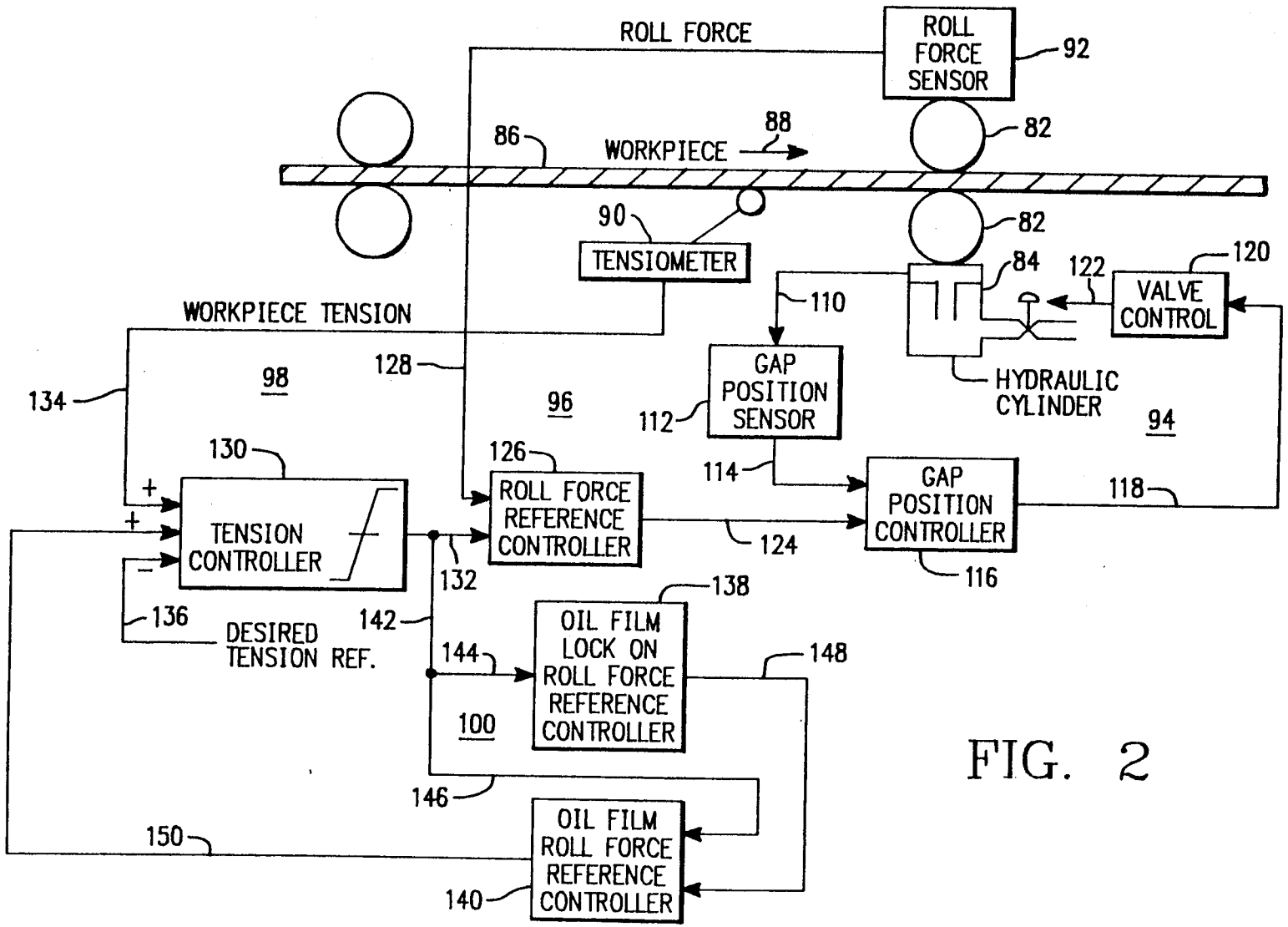
FIG. 2 is a schematic diagram showing in block form a simplified control system of a second embodiment of the invention.

FIG. 2 illustrates an arrangement for a mill stand represented by work rolls 82 whose roll gap is controlled by an hydraulic piston cylinder assembly such as that indicated at 84. Work rolls 82 may represent a typical four high stand where the backup rolls are not shown for simplicity. This arrangement of FIG. 2 finds particular application in a stand where work rolls 82 have smooth surfaces for roll reduction, as is found in all the stands of a tin tandem cold mill, and in at least all but the last stand of a sheet cold mill, more about which will be discussed shortly.

In FIG. 2, workpiece 86 enters the roll gap of work rolls 82 in the direction indicated by the arrow at 88. The tension and/or speed of workpiece 86 is being sensed by tensiometer 90 in the manner taught for that of FIG. 1, and the roll force is being sensed by sensor 92. According to well-known practice, constant roll gap control is achieved by taking into account the apparent roll gap, the roll force, and the tension in workpiece 86.

The use of these parameters are shown by control loops 94, 96, and 98 in the upper part of the arrangement of FIG. 2. Loop 100 is interconnected to loops 96 and 98 in a manner to be discussed hereinafter and represents the component for roll gap control due to speed effects in accordance with the teachings of the invention.

With regard to innermost loop 94 for roll gap control, the position of work rolls 82 is sensed on line 110 by position sensor 112 whose output on lead 114 is representative of the apparent roll gap. This output from sensor 112 is part of the input to a gap position controller 116. The output on lead 118 is an input to a valve mechanism 120 which controls the flow of fluid into a cylinder of hydraulic piston cylinder assembly 84 as indicated on lead 122.

For stability purposes for this hydraulic system of innermost loop 94, it is known to use the roll force indirectly by way of a roll force reference. This roll force reference is shown by an output lead 124 from a roll force reference controller 126. This output on lead 124 is an additional input to gap position controller 116. As can be seen in FIG. 2, part of the input on lead 128 to roll force reference controller 126 is the actual roll force sensed by roll force sensor 92, and part of the input is from tension controller 130 as shown on lead 132. In turn, workpiece tension controller 130 receives input from three different sources.

The invention represented by lower loop 100 consists of an oil film "lock on" roll force controller 138 which is equivalent to the roll force memory circuit 41 of FIG. 1, and an oil film roll force reference controller 140 which is equivalent to summing junction 68 and oil film roll controller 74 of FIG. 1.

In the invention, the output on lead 132 from the workpiece tension controller 130 is fed into roll force reference controller 126 along with the output from roll force sensor 92 for controlling the roll gap by innermost loop 94. The output on lead 132 of workpiece tension controller 130 is also fed on lead 142 into both the oil film lock on roll force reference control 138 as indicated on lead 144 and the oil film roll force reference controller 140 as indicated on lead 146.

The output from oil film roll force reference control 138 as indicated on lead 148 is fed into the oil film roll force reference controller 140, whose output is then fed into strip tension controller 130 on lead 150 to complete the feedback loop 100 for components 138 and 140.

During normal operation of the mill, the invention of FIG. 2 is operated in the same manner discussed for the embodiment of FIG. 1. The difference is that the "lock on" rol force is obtained by an output signal from strip tension controller 130. This output signal from controller 130 may be based generally on the desired tension for the workpiece supplied by the computer or on the actual tension in workpiece 86 depending on which signals are being sent to controller 130.

The operation of the invention of FIG. 2 is similar to that of FIG. 1, the main difference being that oil film lock on roll force reference control 138 and oil film force reference controller 140 receive their input from a roll force reference which is the output from workpiece tension controller 130 instead of a roll force directly obtained from roll force sensor 22 of FIG. 1. Since the inner roll force loop 96 is very fast, the roll force reference for workpiece tension controller 130 will match the roll force feedback signal 128 to the roll force reference controller 126.

In operation of the invention of FIG. 2, when the mill is in its threading stage and it is in its "tension by speed" mode just prior to acceleration, tensiometer 90 may not be functioning to provide an input to strip tension controller 130. At this time, the inputs into strip tension controller 130 are the desired tension value on lead 136 and an input on lead 150 from oil film roll force reference controller 140. In this stage which is still "prior to acceleration," loop 94 for roll gap control is regulated to a roll gap setting provided by the operator according to well-known operating practice with no input from the tensiometer 90 or the roll force sensor 92. During this time the output signal 124 from the roll force reference controller 126 is set equal to the roll gap setting of the operator. Likewise, the output 132 of the tension controller 130 is set equal to the roll force in sensor 92. Now during acceleration when the workpiece tension regulator is switched from tension by speed to tension by roll gap where loops 96 and 98 now control the input to loop 94, there will be a bumpless transfer from tension by speed mode to the tension by roll gap mode.

The components 138 and 140 of the invention are not operating until this time, in which the output from tension controller 130 is representative only of the input from roll force sensor 92. This output from strip tension controller 130 then would be equivalent to the roll force in the stand represented by work rolls 82. For all practical purposes, this is true if gap control regulating loop 94 and roll force loop 96 are operating quickly. This output signal of strip tension controller 130 is continually being fed to loop 100 where a lock on roll force reference is stored in control 138.

As in the invention of FIG. 1, this lock on roll force reference will be an average of the output signal of tension controller 130. When oil film roll force reference controller 140 is energized, its input is then the average roll force reference from control 140, and the output from tension controller 130, whose input, in turn, is eventually the algebraic sum of the inputs of leads 134, 136, and 150.

Preferably, regardless of whether the mill is operating in the threading, full run, or tailing out phase, prior to the acceleration and deceleration phases, an input from tensiometer 90 is being supplied to tension controller 130 for a representative roll force to be fed to the components 138 and 140 of the invention for use during the acceleration and/or deceleration phases for operation of the invention in the manner described for FIG. 1.

Figure 3:
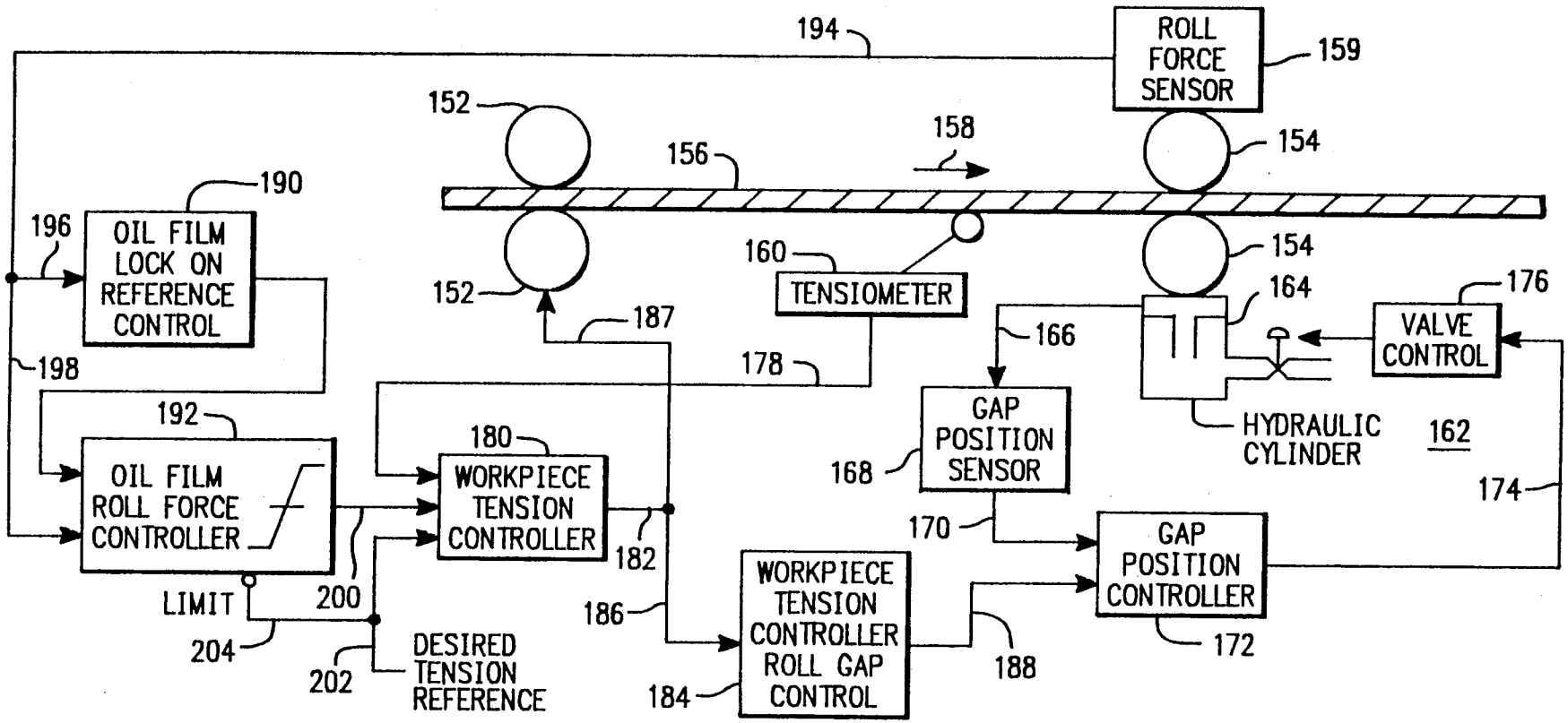
FIG. 3 is a schematic diagram showing in block form a simplified control system of a third embodiment of the invention.

Referring now to the arrangement of FIG. 3, there is shown an upstream roll stand represented by work rolls 154 and a downstream stand represented by work rolls 152. A workpiece 156 travels through these two stands in the direction indicated by arrow 158.

Tensiometer 160 detects the tension in workpiece 156. These two stands represent the last two stands in a sheet cold mill where the work rolls 154 of the last stand are sandblasted to obtain a surface finishing in workpiece 156. According to well-known practice, tension in workpiece 156 is always regulated by controlling the speed relationship between these last two stands. That is, the "tension by speed" mode for the interstand tension regulator between these last two stands is retained with the speeds of the motors driving the work rolls of the downstream stands including work rolls 152 being regulated relative to each other.

According to well-known practice, the roll gap of the last stand represented by work rolls 154 preferably is not changed at any time during the three different main stages of the operation of the mill. Changing of the roll gap of the last stand tends to cause operational problems which are well-known in the industry. In accordance with the teachings of the invention, however, the roll gap of work rolls 154 can now be changed particularly during the "tension by gap" mode of the mill when the downstream stands are in this "tension by gap" mode, more about which will be discussed further.

As shown in FIG. 3, the speed relationship between the last two stands for roll gap control of the last stand is still maintained when using the invention. As shown at the upper left of FIG. 3 the invention is easily incorporated into an existing mill with a roll gap control system being shown to the right in FIG. 3. Preferably, when the invention is being operated, the roll gap control system shown to the right of FIG. 3 is not being operated by the workpiece tension controller roll gap control.

As is known in the art, the roll gap of work rolls 154 is controlled by loop 162 where hydraulic cylinder 164 positions the lower work roll 154. On lead 166 of loop 162, the positioning of this lower roll 154 is sensed by gap position sensor 168. This positioning of lower work roll 154 represents the apparent roll gap. The output from sensor 168 is on lead 170, and is part of the input to gap position controller 172, whose output on lead 174, in turn, is input to a valve control 176 which regulates the hydraulic flow to hydraulic cylinder 164.

The roll force is sensed by roll force sensor 159 located above the upper work roll 154 in FIG. 3. The actual tension in workpiece 156 is detected by tensiometer 160, whose output on lead 178 goes into workpiece tension controller 180. The output along lead 188 from strip tension controller 180 as shown along lead 182 goes into both strip tension controller roll gap control 184 as shown by lead 186 and to the motor for driving the work rolls 152 of the downstream stand as shown by lead 187. Tension controller roll gap control 184 provides part of the input to gap position controller 172 for roll gap control of work rolls 154 of the upstream stand.

The invention of FIG. 3 consists of an oil film lock on reference control 190 which operates similarly to the roll force memory unit 41 of FIG. 1, and an oil film roll force controller 192 which operates similarly to the oil film roll force controller 74 and the summing junction 68 of FIG. 1.

With regard to the invention, a signal from roll force sensor 159 is directed on lead 194 into component 190 on lead 196 and into component 192 on lead 198. The output on lead 200 from controller 192 is one input to workpiece tension controller 180, which as already stated, also receives input on lead 178 from tensiometer 160. A third input into tension controller 180 is on lead 202 representing a desired tension value supplied by either the mill operator or by the computer. Line 204 branching from line 202 indicates that limits are placed on the magnitude of the output 200 of controller 192 which limits, as discussed, are in the range of a typical ±25% of the desired tension reference on lead 202.

The operation of the invention in the arrangement of FIG. 3 is similar to that of FIG. 1. The roll force of work rolls 154 is used to obtain both a lock on roll force in control 190 and an instantaneous rolling force as input on lead 198 into oil film roll force controller 192. The tension reference from controller 192 on lead 200 is used along with the input on lead 178 from tensiometer 160, if such input is available, and the input on lead 202 to generate an error tension value. This error tension value is directed as output on leads 186 and 187.

The input on lead 187 is representative of a change in the speed for the motors driving work rolls 152. This stand speed reference change then regulates the speed of work rolls 152 at a desired rate to obtain the required tension in workpiece 156. The input on lead 186 is used to regulate the roll gap control system of work rolls 154 by way of loop 162.

As was discussed with reference to FIG. 1 during the threading stage of the mill and into the acceleration phase, workpiece tension controller 180 will always have an input from tensiometer 160 and will always control the speeds of the downstream stand of work roll 152 to control the tension in workpiece 156.

During the mill acceleration phase, when the downstream workpiece tension regulators are switched from tension by speed to tension by roll gap at the high mill speeds plus a time delay, the oil film roll force controller 192 is energized and an input 200 is added to the tension controller 180 in addition to the desired tension value.

After the mill stops accelerating, the oil film roll force controller 192 is de-energized and its output signal 200 is slowly decayed to zero. The delivery automatic gauge control system for the mill is capable now of adequately controlling the strip thickness to the desired value as it leaves the mill. For a fixed time period, after the acceleration phase, the workpiece tension controller roll gap control 184 will change the upstream roll gap of work rolls 154 to cause the output signal 182 from the workpiece tension controller 180 to go to zero. By reducig the magnitude of the output signal 182 of the workpiece tension controller 180 by slowly changing the roll gap of the upstream work rolls 154, the strip reduction in the last stand of work rolls 154 which has sandblasted rolls is now equal to that as determined by the mill operator. Preferably, the workpiece tension controller roll gap control 184 is only operational when the oil film roll force controller 192 is not in operation.

Preferably, during the acceleration and the declaration phases, the components 190 and 192 of the invention of FIG. 3 are operating with workpiece tension controller 180 changing the speed regulator for work rolls 152. This stand speed reference change causes a reduction in the workpiece 156 in the last stand of work rolls 152 according to well-known rolling mill principles. When the components 190 and 192 are not operating, which essentially is in the threading, full run, and tailing out phases of the mill, the workpiece tension controller roll gap control 184 can be operated for controlling the roll gap of the upstream stand of work rolls 154 and/or a speed reference from workpiece tension controller 180 can be supplied to the speed regulator of the downstream stand of work rolls 152 without any input into workpiece tension controller 180 from the oil film roll force controller 192.

FIG. 3 represents a last stand of a sheet cold mill wherein the rolls are sandblasted for surface finish. It is to be understood that the downstream stands can employ the embodiment of the invention shown in FIG. 2 for smooth work rolls if the roll gap control is regulated by an hydraulic piston cylinder control system or the embodiment of FIG. 1 if the roll gap control is regulated by an electromechanical screwdown control system.

The embodiment of FIG. 3 shows an hydraulic roll gap control system, however, it is to be understood that an electromechanical screwdown can also be used, and the invention operated in the same manner as described for FIG. 3.

Even though one roll stand has essentially been discussed with reference to the invention, it is to be understood that the embodiments of FIGS. 1 and 2 in particular can be applied to each of the stands in any type of tandem cold mill.

The reason the oil film roll force controller (FIGS. 1 and 3) and the oil film roll force reference controller 140 (FIG. 2) compensate within a typical ±25% limit range with regard to the desired tension is to prevent the tension from becoming too high or low. If the tension in the workpiece is too high, the workpiece may break, and if, too low, the workpiece may develop wavy edges resulting in thickness variation across the width of the workpiece.

The invention has been disclosed in terms of components and/or devices interacting with existing devices control systems, and mechanisms in a roll stand. However, it is to be appreciated that the invention can be implemented by the electrical circuit of FIG. 1 and/or a computer program easily integrated into a microprocessor of the mill control system.

From the above, it can be seen that the roll gap for the workpiece is held constant during the time when "speed effects" occur to produce a relatively on gauge length in the workpiece, resulting in a higher percentage of workpiece length being within gauge tolerance.

Whereas a particular embodiment of the invention have been described above for purposes of illustration, it will be evident to those skilled in the art that numerous variations of the details may be made without departing from the invention as defined in the appended claims.

We claim:

1. A method for compensating for speed effects in a stand of a tandem cold mill having two work roll assemblies defining a roll gap through which a workpiece travels, and which roll gap is controlled by roll gap means, the steps comprising:

during the operation of said mill and prior to the acceleration and deceleration phases of said mill where the speed of said stand is running at a low rate or at a high rate, sensing and generating a representation for a roll force in said stand being exerted on said work roll assemblies and storing an updated value of said roll force representation being exerted on said work roll assemblies for said roll gap control, immediately prior to said acceleration and deceleration phases, memorizing said updated representation for said roll force, and during said acceleration and deceleration phases of said stand, continually performing the following steps:

using said memorized updated roll force representation and a representation of an instantaneous roll force, and producing a roll force error value representative of a change in said roll gap and in the tension in said workpiece due to said speed effects, converting said roll force error value into a percentage of a desired tension value for said workpiece, using said converted value with said desired tension value and with an actual tension value in said workpiece to produce a tension error value, and employing said tension error value to vary and control said roll gap to produce a relatively on gauge workpiece along the length of said workpiece travelling through said mill during said acceleration and deceleration phases of said mill, whereby a constant roll force is produced in said stand which allows said roll gap to open or remain opened during said acceleration phase in which said speed effects usually cause said roll gap to close and which allows said roll gap to close or remain closed during said deceleration phase in which said speed effects usually cause said roll gap to open.

2. A method of claim 1, the steps further comprising:

directly using a roll force value from a roll force sensor for said memorized updated representation of said roll force and for said instantaneous roll force.

3. A method of claim 2, the steps further comprising:

using said actual tension and algebraically summing this actual tension with said converted roll force error value and with said desired tension value for said production of said tension error value for directly controlling said roll gap of said stand.

4. A method of claim 1, the steps further comprising:

using an actual tension value in said workpiece for obtaining said memorized updated representation of said roll force and said instantaneous roll force immediately prior to acceleration and deceleration phases of said mill.

5. A method of claim 4, the steps further comprising:

during said acceleration and deceleration phases of said stand, combining said tension error value with a roll force value derived from a roll force sensor for controlling said roll gap.

6. A method of claim 1, in said converting of said roll force error value into a percentage of a desired tension value for said workpiece, using a ±25% range of said desired tension value to limit the magnitude of said roll force error value.

7. A method of claim 1, wherein said stand is the last stand of a sheet cold mill and said work roll assemblies are sandblasted to provide a surface finish and said mill has an downstream stand relative to said last stand, the steps further comprising:

using said tension error value to change the speed of said downstream stand relative to the change in tension in said workpiece, whereby said roll gap of said last stand is controlled for said production of said on gauge workpiece.

8. A method of claim 1, the steps further comprising:

immediately prior to said operation of said mill where said stand is to run at a slow speed and at a high speed, interrupting said production of said roll force error value, and slowly decaying said stored updated representation on said roll force to zero.

9. A method of claim 1, the steps further comprising:

employing said stand in a tin cold mill wherein said work roll assemblies have smooth surfaces for the reduction of said workpiece.

10. A method of claim 1, the steps further comprising:

employing said stand in a sheet cold mill wherein said work roll assemblies have smooth surfaces for the reduction of said workpiece.

11. A method of claim 1, the steps further comprising:
employing an electromechanical screw down means for said roll gap control.

12. A method of claim 1, the steps further comprising:
employing an hydraulic piston cylinder control system for said roll cap control.

13. A method for compensating for speed effects in a stand of a tandem cold mill having two work roll assemblies defining a roll gap through which a workpiece travels, and which roll gap is controlled by roll gap means, the steps comprising:

during operation of said mill where the speed of said stand is running at a substantially constant speed, and at least prior to a first and a second change in said speed, sensing and generating a value for the actual roll force being exerted on said work roll assemblies, and storing an updated said value for said actual roll force, immediately prior to said first and second change of said speed of said stand memorizing said updated roll force value, and during said first and second change of said speed of said stand, continually performing the following steps, algebraically summing said memorized updated roll force and an instantaneous roll force, and producing a roll force differential value representative of a change in said roll gap and in the tension in said workpiece due to speed effects.

converting said roll force error value into a percentage of a desired tension value for said workpiece, algebraically summing said converted value with said desired tension value and with an actual tension value in said workpiece to produce a tension error value, and directly employing said tension error value to vary and control said roll gap to produce an on gauge workpiece along the length of said workpiece travelling through said mill stand during said first and second change of said speed of said stand, whereby a constant roll force is produced in said stand which allows said roll gap to open or remain opened during said first change in said speed in which said speed effects usually cause said roll gap to close and which allows said roll gap to close or remain closed during said second change of speed in which said speed effects usually cause said roll gap to open.

14. A method of compensating for speed effects in a stand of a tandem cold mill having work roll assemblies, defining a roll gap through which a workpiece travels and which said roll gap is controlled by roll gap means, the steps comprising:

during operation of said mill where the speed of said stand is at a low first constant speed and at a high second constant speed, and at least prior to a change in said constant speeds, performing the following steps:

sensing and generating a value for a roll force being exerted on said work roll assemblies, and using this roll force value for said roll gap control, sensing and generating a value for the actual tension in said workpiece, using said actual tension value as being a representation of said roll force being exerted on said work roll assemblies, and storing an updated said representation of said roll force, immediately prior to said first and second change of said constant speed of said stand, memorizing said updated representation of said roll force, and during said first and second change of said speed of said stand, continually performing the following steps:

algebraically summing said memorized updated representation of said roll force and an instantaneous roll force representation, and producing a roll force error value representative of a change in said roll gap and in tension in said workpiece due to said speed effects, converting said roll force error value into a percentage of a desired tension value for said workpiece, algebraically summing said converted value with said desired tension value and with an actual tension value in said workpiece to produce a tension error value, employing said tension error value as said instantaneous roll force representation in said production of said roll force value, and combining said tension error value with said actual roll force value to produce a roll gap reference used for said control of said roll gap means to produce an on gauge workpiece along the length of said workpiece travelling through said mill during said first and second change of said speed of said stand, whereby a constant roll force is produced in said stand which allows said roll gap to open or remain opened during first change in said speed in which said speed effects usually cause said roll gap to close and which allows said roll gap to close or remain closed during said second change of speed in which said speed effects usually cause said roll gap to open.

15. A method of compensating for speed effects in the last stand of a tandem sheet cold mill having two work roll assemblies which generally provide a surface finish and which define a roll gap through which a workpiece travels, and which mill has a downstream stand, which roll gap, of said last stand is controlled by roll gap means, the steps comprising:

during operation of said mill where the speed of said last stand is at a relatively constant low or high speed, sensing and generating a value for the actual roll force being exerted on said work roll assemblies, and storing an updated value for said actual roll force, immediately prior to a first change of said constant speed of said last stand from a low to high speed or prior to a second change of said constant speed of said last stand from a high to low speed, memorizing said updated roll force value, and during said change of said speed of said last stand, continually performing the following steps:

algebraically summing said memorized updated roll force value and an instantaneous roll force, and producing a roll force error value representative of a change in said roll gap and in the tension in said workpiece due to speed effects, converting said roll force error value into a percentage of a desired tension value for said workpiece, algebraically summing said converted value with said desired tension value and with an actual tension value in said workpiece to produce a tension error value, and employing said tension error value to change the speed of said downstream stand relative to a change in tension in said workpiece, whereby said roll gap of said last stand is controlled to produce an on gauge workpiece along the length of said workpiece travelling through said mill during said change of said constant speed of said mill, whereby a constant roll force is produced in said last stand which allows said roll gap to open or remain opened during said first change in said speed in which said speed effects usually cause said roll gap to close and which allows said roll gap to close or remain closed during said second change of speed in which said speed effects usually cause said roll gap to open.

16. A control system for compensating for speed effects in a stand of a tandem cold mill having two work roll assemblies defining a roll gap through which a workpiece travels, and which roll gap is controlled by roll gap means, the steps comprising:

means for sensing a representation for a roll force in said stand being exerted on said work roll assemblies prior to an acceleration and a deceleration phase of said mill, means for storing an updated said representation of said roll force being exerted on said work roll assemblies for said roll gap control, means for memorizing said updated representation of said roll force immediately prior to said acceleration phase and said deceleration phases of said mill, means for using said memorized updated roll force representation and a representation of an instantaneous roll force being exerted on said work roll assemblies and producing a roll force error value representative of a change in said roll gap and in the tension in said workpiece due to said speed effects, means for converting said roll force error value into a percentage of a desired tension value for said workpiece, means for using said converted value with a desired tension value and with an actual tension value in said workpiece to produce a tension error value, and means for employing said tension error value to vary and control said roll gap to produce an on gauge workpiece along the length of said workpiece travelling through said mill during said acceleration and deceleration phases of said mill, whereby a constant roll force is produced in said stand which allows said roll gap to open or remain opened during said acceleration phase in which said speed effects usually cause said roll gap to close and which allows said roll gap to close or remain closed during said deceleration phase in which said speed effects usually cause said roll gap to open.

17. A control system of claim 16, further comprising:

means for directly using a roll force value from a force sensor for said memorized updated representation of said roll force and for said instantaneous roll force.

18. A control system of claim 17, further comprising:

means for using said actual tension and using said actual tension with said converted roll force error value and with said desired tension value for said production of said tension error value for directly controlling said roll gap of said stand.

19. A control system of claim 16, further comprising:

means for using an actual tension value in said workpiece for obtaining said memorized updated representation of said roll force and said instantaneous roll force immediately prior to said acceleration and deceleration phases of said mill.

20. A control system of claim 19, further comprising:

means for combining said tension error value with a roll force value derived from a roll force sensor for controlling said roll gap during said acceleration and deceleration phases of said mill.

21. A control system of claim 16, further comprising:

means for converting said roll force error value into a typical ±25% range of said desired tension value to limit the magnitude of said roll force error value.

22. A control system of claim 16, wherein said stand is the last stand of a sheet cold mill and said work roll assemblies are sandblasted to provide a surface finish and said mill has an downstream stand relative to said last stand, further comprising:

means for using said tension error value to change the speed of said downstream stand relative to the change in tension in said workpiece, whereby said roll gap of said last stand is controlled for said production of said on gauge workpiece.

23. A control system of claim 16, further comprising:

means for interrupting said production of said roll force error value immediately prior to said operation of said mill where said stand is to run either at a slow speed or at a high speed, and means for slowly decaying said locked on updated representation of said roll force to zero.

24. A control system for compensating for speed effects in a stand of tandem cold mill having two work roll assemblies defining a roll gap through which a workpiece travels, and which roll gap is controlled by roll gap means, comprising:

means for sensing and generating a value for the actual roll force being exerted on said work roll assemblies, and storing an updated said value for said actual roll force, during operation of said mill where the speed of said stand is running at a substantially constant speed, and at least prior to a first and a second change in said speed, means for memorizing said updated roll force value immediately prior to said change of said speed of said stand, means for algebraically summing said memorizing updated roll force and an instantaneous roll force and producing a roll force error value representative of a change in said roll gap and in the tension in said workpiece due to speed effects, means for converting said roll force error value into a percentage of a desired tension value for said workpiece, means for algebraically summing said converted value with said desired tension value and with an actual tension value in said workpiece to produce a tension error value, and means for directly employing said tension error value to vary and control said roll gap to produce an on gauge workpiece along the length of said workpiece travelling through said mill during said first and second change of said speed of said stand, whereby a constant roll force is produced in said stand which allows said roll gap to open or remain opened during said first change in said speed in which said speed effects usually cause said roll gap to close and which allows said roll gap to close or remain closed during said second change of speed in which said speed effects usually cause said roll gap to open.

25. A control system for compensating for speed effects in a stand of a tandem cold mill having work roll assemblies, defining a roll gap through which a workpiece travels and which said roll gap is controlled by a roll gap means, comprising:

means for sensing and generating a value for a roll force being exerted on said work roll assemblies, and using this roll force value for said roll gap control, means for sensing and generating a value for the actual tension in said workpiece, means for using said actual tension value as being representation of said roll force being exerted on said work roll assemblies, and means for storing an updated said representation of said roll force, means for memorizing said updated representation of said roll force, immediately prior to a first and second change of said constant speed of said stand, means for algebraically summing said memorized updated roll force representation and an instantaneous roll force representation, and producing a roll force error value representative of a change in said roll gap and in the tension is said workpiece due to said speed effects, means for converting said roll force error value into a percentage of a desired tension value for said workpiece, means for algebraically summing said converted value with said desired tension value and with an actual tension value in said workpiece to produce a tension error value, means for employing said tension error value as said instantaneous roll force representation in said production of said roll force error value, and means for combining said tension error value with said actual roll force value to produce a roll gap reference used for said roll gap control to produce an on gauge workpiece along the length of said workpiece travelling through said mill during said first and second change of said speed of said stand, whereby a constant roll force is produced in said stand which allows said roll gap to open or remain opened during said first change in said speed in which said speed effects usually cause said roll gap to close and which allows said roll gap to close or remain closed during said second change of speed in which said speed effects usually cause said roll gap to open.

26. A control system for compensating for speed effects in the last stand of a tandem sheet cold mill having two work roll assemblies which generally provide a surface finish and which define a roll gap through which a workpiece travels, and which mill has a downstream stand, which roll gap of said last stand is controlled by roll gap means, comprising:

means for sensing and generating a value for the actual roll force being exerted on said work roll assemblies, and storing an updated value for said actual roll force during operation of said mill where the speed of said last stand is at a low constant speed and a high constant speed, means for memorizing on said updated roll force value, immediately prior to a first and second change of said speed of said last stand, means for algebraically summing said memorizing updated roll force value and an instantaneous roll force, and producing a roll force error value representative of a change in said roll gap and in the tension in said workpiece due to speed effects, means for converting said roll force error value into a percentage of a desired tension value for said workpiece, means for algebraically summing said converted value with said desired tension value and with an actual tension value in said workpiece to produce a tension error value, and means for using said tension error value to change the speed of said downstream stand relative to a change in tension in said workpiece, whereby said roll gap means of said last stand controlled to produce an on gauge workpiece along the length of said workpiece travelling through said mill during said first and second change of said constant speed of said mill, whereby a constant roll force is produced in said last stand which allows said roll gap to open or remain opened during said first change in said speed in which said speed effects usually cause said roll gap to close and which allows said roll gap to close or remain closed during said second change of speed in which said speed effects usually cause said roll gap to open.

27. A method for rolling a workpiece in a stand of a tandem cold mill having a plurality of stands, said stand having two work roll assemblies defining a roll gap through which a workpiece travels, and which roll gap is controlled by roll gap means, the steps comprising:

during the operation of said mill at substantially constant speed and prior to a first and second change in said speed, sensing and generating a representation for a roll force in said stand being exerted on said work roll assemblies, and storing an updated value for said roll force representation being exerted on said work roll assemblies for said roll gap control, immediately prior to said first and second change in said speed of said stand, memorizing said updated representation for said roll force, during said first and second change in said speed of said stand, using said memorizing updated roll force representation and an instantaneous roll force to obtain a roll force error value, and employing this roll force error signal to vary and control said roll gas means to compensate for speed effects occuring in said stand during said change in said speed of said stand to produce a relatively on gauge workpiece along the length of the workpiece travelling through said mill during said first and second change of said speed in said stand, whereby a constant roll force is produced in said stand which allows said roll gap to open or remain opened during said first change in said speed in which said speed effects usually cause said roll gap to close and which allows said roll gap to close or remain closed during said second change of speed in which said speed effects usually cause said roll gap to open.

28. A method of claim 27, the steps further comprising:

in said employing of said roll force error value including converting said roll force error value into a percentage of a designated tension value for said workpiece.

29. A method of claim 28, including using a ±25% range of said desired tension value to limit the magnitude of said roll force error value.

30. A method of claim 28, including employing a proportional integrator type controller for said converting of said roll force error signal.

31. A method of claim 27, including employing a roll memory circuit unit for said storing and memorized said updated roll force representation.

32. A control means for rolling a workpiece in a stand of a tandem cold mill having a plurality of stands, said stand having two work roll assemblies defining a roll gap through which a workpiece travels, and which roll gap is controlled by roll gap means comprising:

means operating prior to the acceleration and deceleration phases of said mill for sensing and generating a representation for a roll force in said stand being exerted on said work roll assemblies, means for storing an updated value for said roll force representation, including means operating immediately prior to said acceleration and deceleration phases for memorizing said updated representation for said roll force, means for employing said memorized updated roll force representation and an instantaneous roll force representation to obtain a roll force error value during said acceleration and deceleration phases of said mill, and means for employing said roll force error value to vary and to control said roll gap means to compensate for speed effects occurring in said stand during said acceleration and deceleration phases of said mill to produce a relatively on gauge workpiece along the length of said workpiece travelling through said mill during said acceleration and deceleration phases, whereby a constant roll force is produced in said stand which allows said roll gap to open or remain opened during said acceleration phase in which said speed effects usually cause said roll gap to close and which allows said roll gap to close or remain closed during said deceleration phase in which said speed effects usually cause said roll gap to open.

33. A control means of claim 32, wherein said means for employing said roll force error value includes means for converting said roll force error valuer into a percentage of a desired tension value for said workpiece.

34. A control means of claim 33, wherein said converting means includes means for limiting the magnitude of said roll force error value within a typical ±25% range of said desired tension value.

35. A control means of claim 33, wherein said converting means is a proportional integrator.

36. A control means of claim 32, wherein said means for storing and memorizing said updated roll force representation includes a roll force memory circuit unit.

* * * * *

UNITED STATES PATENT AND TRADEMARK OFFICE

CERTIFICATE OF CORRECTION

PATENT NO. : 5,012,660

DATED : May 7, 1991

INVENTOR(S) : ROBERT S. PETERSON et al.

It is certified that error appears in the above-identified patent and that said Letters Patent is hereby corrected as shown below:

Claim 13, column 15, line 29, "." should be --,--.

Claim 14, column 16, line 11, "in tension" should read --in the tension--.

Claim 14, column 16, line 30, "during first" should read --during said first--.

Claim 24, column 18, line 46, "memorizing" should be --memorized--.

Claim 26, column 20, line 1, "memorizing" should be --memorized--.

Claim 26, column 20, line 16, "stand controlled" should read --stand is controlled--.

Claim 27, column 20, line 45, "memorizing" should be --memorized--.

UNITED STATES PATENT AND TRADEMARK OFFICE

CERTIFICATE OF CORRECTION

PATENT NO. : 5,012,660 Page 2 of 2

DATED : May 7, 1991

INVENTOR(S) : Robert S. Peterson, et al

It is certified that error appears in the above-indentified patent and that said Letters Patent is hereby corrected as shown below:

Claim 33, column 22, line 18, "valuer" should be --value--.

Signed and Sealed this

Twenty-seventh Day of September, 1994

*Attest:*

Bruce Lehman

BRUCE LEHMAN

*Attesting Officer*

*Commissioner of Patents and Trademarks*